US011495421B2

(12) United States Patent
Huang et al.

(10) Patent No.: US 11,495,421 B2
(45) Date of Patent: Nov. 8, 2022

(54) KEYSWITCH AND KEYBOARD THEREOF

(71) Applicant: DARFON ELECTRONICS CORP., Taoyuan (TW)

(72) Inventors: Jui-Yi Huang, Taoyuan (TW); Sheng-Yun Yang, Taoyuan (TW); Chin-Hung Lin, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 77 days.

(21) Appl. No.: 16/814,985

(22) Filed: Mar. 10, 2020

(65) Prior Publication Data

US 2020/0294737 A1 Sep. 17, 2020

(30) Foreign Application Priority Data

Mar. 15, 2019 (TW) ..... 108108773
Dec. 18, 2019 (TW) ..... 108146354

(51) Int. Cl.
*H01H 13/705* (2006.01)
*H01H 13/85* (2006.01)

(52) U.S. Cl.
CPC ..... *H01H 13/705* (2013.01); *H01H 13/85* (2013.01); *H01H 2235/01* (2013.01)

(58) Field of Classification Search
CPC .. H01H 13/705; H01H 13/85; H01H 2235/01; H01H 3/125; H01H 13/84; H01H 2221/028; H01H 2235/002; H01H 2235/018; H01H 13/7065; H01H 2221/036; H01H 2221/044; H01H 13/70; H01H 36/004; H01H 36/0073; H01H 2221/04
See application file for complete search history.

(56) References Cited

U.S. PATENT DOCUMENTS 5,442,152 A * 8/1995 Huang ..... H01H 13/705 200/341
6,962,452 B2 * 11/2005 Cheng ..... G06F 3/0202 400/479
2015/0170854 A1 * 6/2015 Nishino ..... H01H 13/14 200/5 A

FOREIGN PATENT DOCUMENTS

CN 203553003 U 4/2014
CN 206907691 U 1/2018
CN 207977257 U 10/2018

* cited by examiner

*Primary Examiner* — Lheiren Mae A Caroc
(74) *Attorney, Agent, or Firm* — Winston Hsu

(57) ABSTRACT

A keyswitch includes a bottom board, a cap structure, a lifting mechanism, and an elastic member. The lifting mechanism is detachably connected to the cap structure and the bottom board to make the cap structure movable upward and downward relative to the bottom board. The elastic member is connected to the cap structure so as to be detached from the lifting mechanism together with the cap structure when the cap structure is separate from the lifting mechanism.

8 Claims, 9 Drawing Sheets

KEYSWITCH AND KEYBOARD THEREOF

BACKGROUND OF THE INVENTION

1. Field of the Invention

The present invention relates to a keyswitch and a keyboard thereof, and more specifically, to a keyswitch having an elastic member detachable from a lifting mechanism together with a cap structure.

2. Description of the Prior Art

A keyboard, which is the most common input device, could be found in variety of electronic apparatuses for users to input characters, symbols, numerals and so on. Furthermore, from consumer electronic products to industrial machine tools, they are all equipped with a keyboard having keyswitches for performing input operations.

In practical application, for providing different tactile feedbacks (e.g. a clicky or non-clicky linear tactile feedback), the keyboard usually has a function of allowing a user to replace a cap and an internal elastic member (e.g. a spring or a rubber dome) to change the tactile feedback of the keyswitch. However, in the aforesaid design, not only the assembly or replacement process of the cap and the elastic member is time-consuming and strenuous, but accidental missing or damage of related keyswitch members also easily occurs during the assembly or replacement process, so as to cause the user much inconvenience in assembly and disassembly of the cap.

SUMMARY OF THE INVENTION

The present invention provides a keyswitch. The keyswitch includes a bottom board, a cap structure, a lifting mechanism, and an elastic member. The lifting mechanism is detachably connected to the cap structure and the bottom board to make the cap structure movable upward and downward relative to the bottom board. The elastic member is connected to the cap structure to be detached from the lifting mechanism together with the cap structure when the cap structure is separate from the lifting mechanism.

The present invention further provides a keyboard. The keyboard includes a bottom board and a plurality of keyswitches. The plurality of keyswitches is disposed on the bottom board. At least one of the plurality of keyswitches includes a cap structure, a lifting mechanism, and an elastic member. The lifting mechanism is detachably connected to the cap structure and the bottom board to make the cap structure movable upward and downward relative to the bottom board. The elastic member is connected to the cap structure to be detached from the lifting mechanism together with the cap structure when the cap structure is separate from the lifting mechanism.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
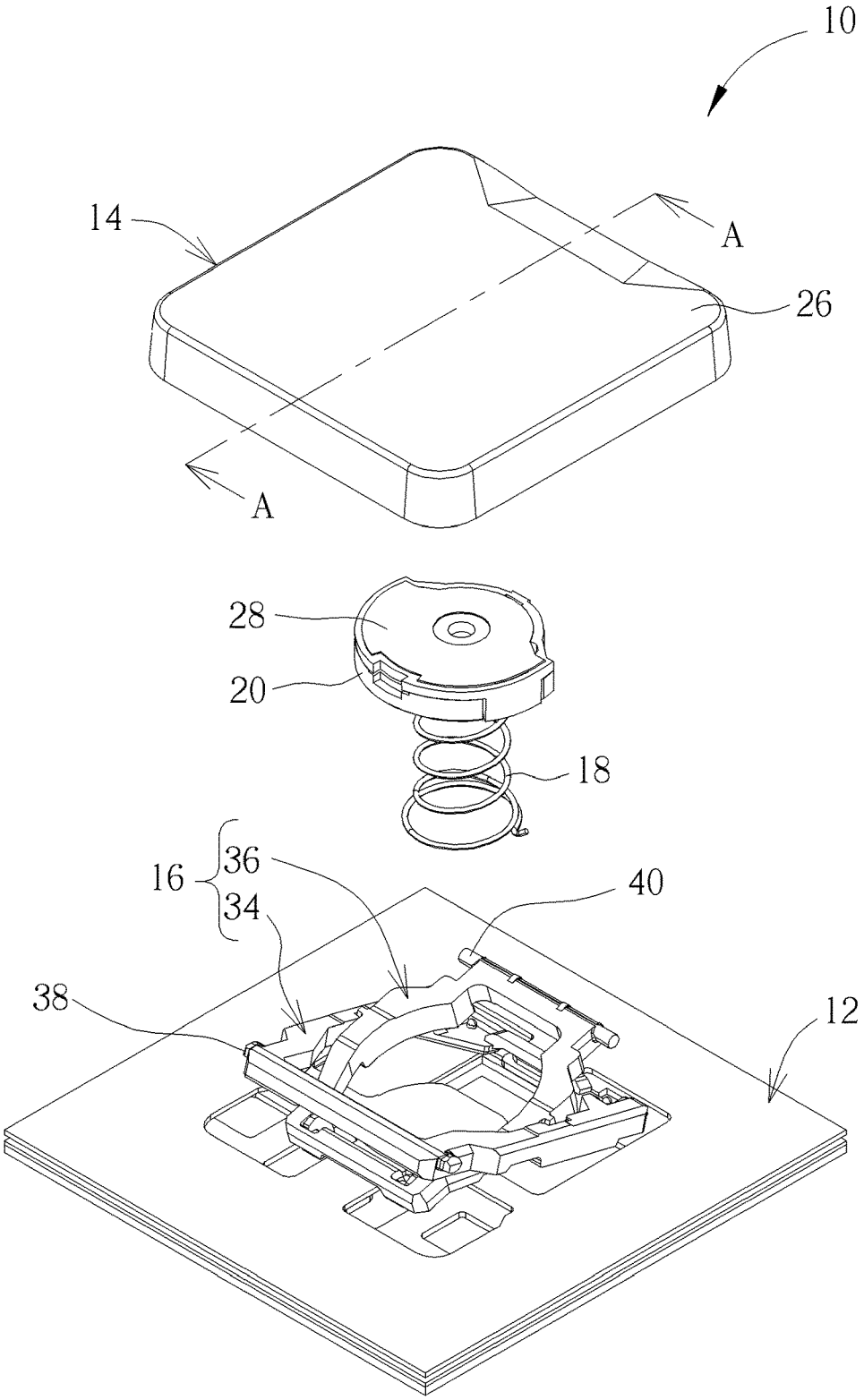
FIG. 1 is a partial exploded diagram of a keyswitch according to an embodiment of the present invention.
Figure 2:
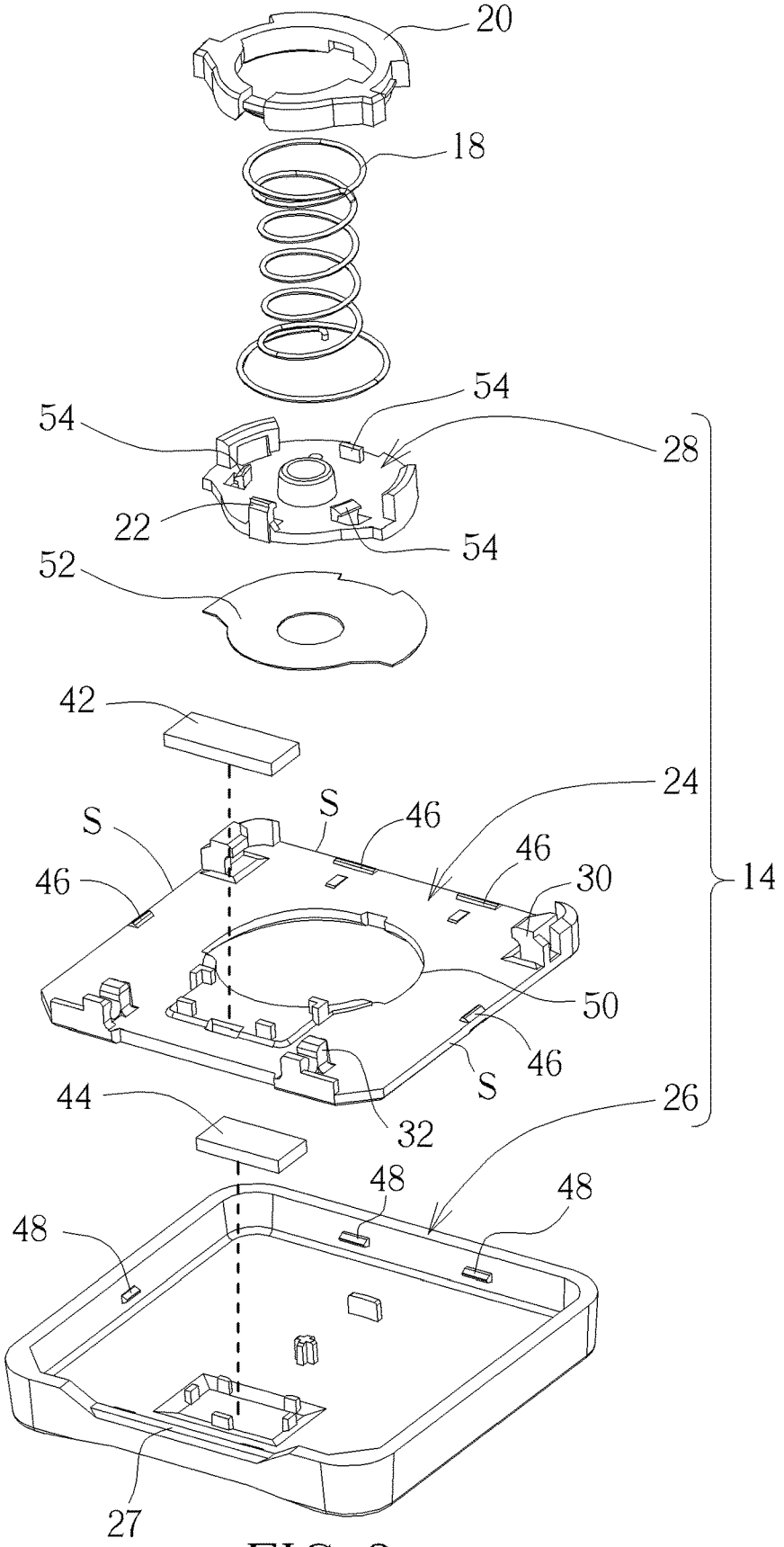
FIG. 2 is an exploded diagram of a cap structure, a spring and a fixing ring in FIG. 1.
Figure 3:
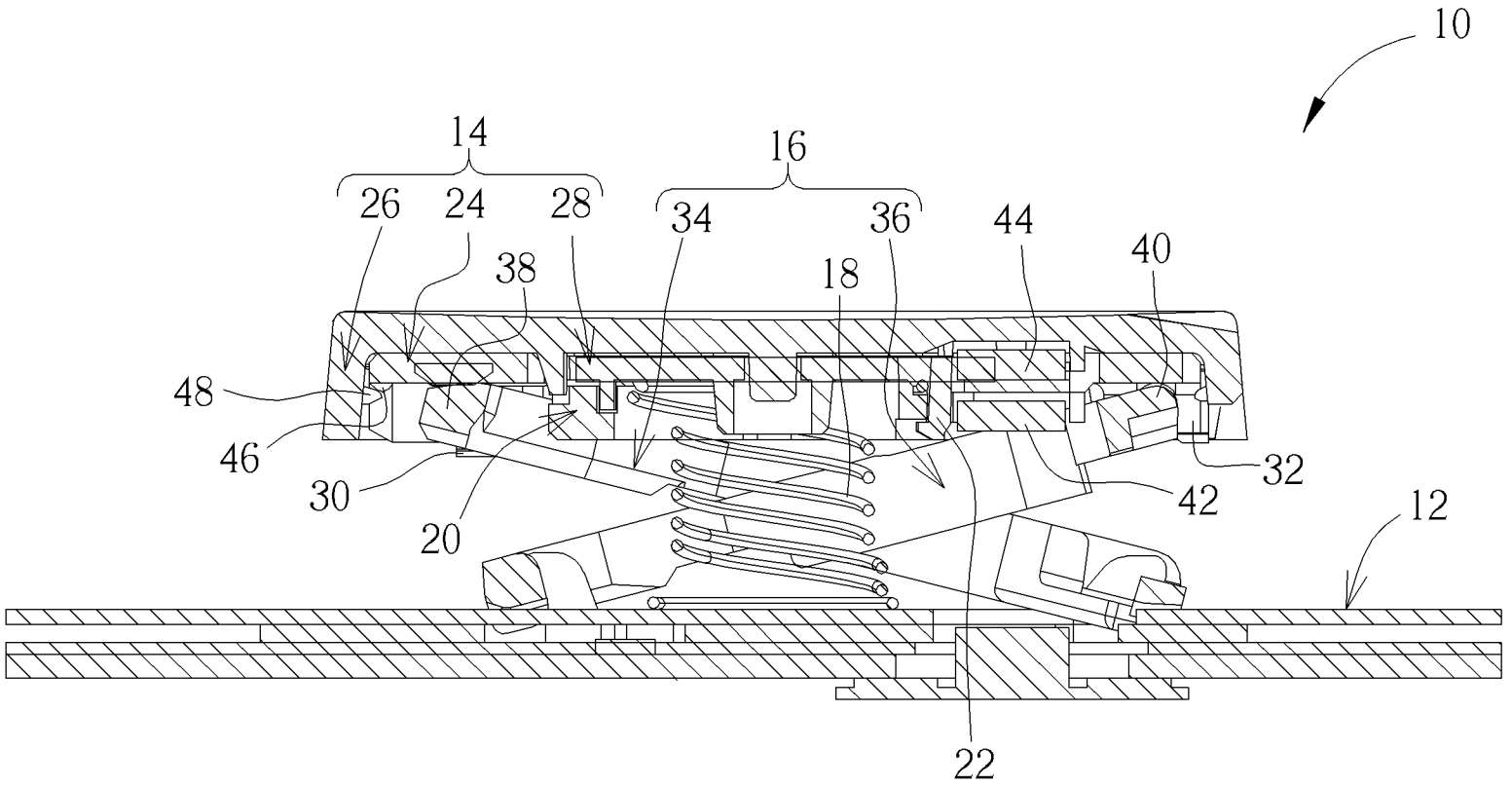
FIG. 3 is a cross-sectional diagram of the keyswitch in FIG. 1 along a cross-sectional line A-A after the assembly process is completed.

Please refer to FIG. 1, FIG. 2, and FIG. 3. FIG. 1 is a partial exploded diagram of a keyswitch 10 according to an embodiment of the present invention. FIG. 2 is an exploded diagram of a cap structure 14, a spring 18 and a fixing ring 20 in FIG. 1. FIG. 3 is a cross-sectional diagram of the keyswitch 10 in FIG. 1 along a cross-sectional line A-A after the assembly process is completed. The keyswitch 10 could be preferably applied to a portable electronic device with a foldable mechanism composed of an upper cover and a lower casing (e.g. a notebook or a foldable keyboard, but not limited thereto) for a user to perform input operations. As shown in FIG. 1, FIG. 2, and FIG. 3, the keyswitch 10 includes a bottom board 12, the cap structure 14, a lifting mechanism 16, the spring 18, and the fixing ring 20. The lifting mechanism 16 is detachably connected to the bottom board 12 and the cap structure 14. Accordingly, the cap structure 14 can move upward and downward relative to the bottom board 12 via the lifting mechanism 16.

As shown in FIG. 2 and FIG. 3, the cap structure 14 has at least one fixing hook 22 (one shown in FIG. 2, but not limited thereto). The spring 18 is engaged with the fixing hook 22 and abuts against the bottom board 12 for driving the cap structure 14 away from the bottom board 12. The fixing ring 20 is detachably engaged with the fixing hook 22 for clamping the spring 18 cooperatively with the cap structure 14. In this embodiment, the cap structure 14 includes a connection member 24, a cap body 26, and a spring fixing base 28. The lifting mechanism 16 could preferably adopt the scissor support mechanical design commonly applied to a keyswitch on a keyboard (but not limited thereto, meaning that the present invention could adopt other lifting mechanical design in another embodiment, such as a magnetic support mechanical design) to be detachably connected to the connection member 24. For example, as shown in FIG. 3, the connection member 24 has a sliding slot 30 and an engaging slot 32. The lifting mechanism 16 includes a first support member 34 and a second support member 36. The first support member 34 and the second support member 36 pivotably intersect with each other. The first support member 34 has a sliding portion 38 and is rotatably connected to the bottom board 12. The sliding portion 38 is slidably connected to the sliding slot 30. The second support member 36 has a pivot portion 40 and is slidably connected to the bottom board 12. The pivot portion 40 is rotatably connected to the engaging slot 32. Via the first support member 34 being slidable relative to the connection member 24 and rotatable relative to the bottom board 12 and the second support member 36 being rotatable relative to the connection member 24 and slidable relative to the bottom board 12, the connection member 24 can be movable upward and downward relative to the bottom board 12.

In practical application, for improving the assembly convenience of the cap structure 14, the connection member 24 could preferably adopt the magnetic attraction design to be detachably disposed under the cap body 26. In this embodiment, as shown in FIG. 2, the connection member 24 has a first magnetic member 42, and the cap body 26 has a second magnetic member 44 corresponding to the first magnetic member 42. Accordingly, the first magnetic member 42 can magnetically attract the second magnetic member 44 to make the connection member 24 detachably disposed under the cap body 26. Further, at least one first positioning structure 46 (preferably a convex inclined structure, but not limited thereto) could be formed on at least one edge S of the connection member 24. For example, as shown in FIG. 2, one first positioning structure 46 is formed on the edges S located at left and right sides of the connection member 24 respectively, and two first positioning structures 46 (but not limited thereto) are formed on the edge S located at a rear side of the connection member 24. Second positioning structures 48 (preferably protruding ribs, but not limited thereto) are formed on the cap body 26 corresponding to the first positioning structures 46. As such, the first positioning structure 46 can be engaged with the corresponding second positioning structure 48 to make the connection member 24 disposed under the cap body 26 more steadily. To be noted, as shown in FIG. 2, a recessed structure 27 could be preferably formed on a side of the cap body 26 corresponding to the second magnetic member 44, so that the user can detach the cap structure 14 via the recessed structure 27 conveniently.

Furthermore, as shown in FIG. 2 and FIG. 3, in this embodiment, a hole 50 is formed on the connection member 24 corresponding to the spring 18, and the spring fixing base 28 has a fixing hook 22 formed thereon and is connected to the cap body 26 corresponding to the hole 50 (e.g. the spring fixing base 28 could be attached under the cap body 26 via a glue layer 52 as shown in FIG. 2, but not limited thereto, meaning that the present invention could adopt other connection design, such as a structural engagement design). In such a manner, the fixing ring 20 can be detachably engaged with the fixing hook 22 to clamp the spring 18 cooperatively with the spring fixing base 28 (as shown in FIG. 3). To be noted, as shown in FIG. 2, at least one limiting block 54 (three shown in FIG. 2, but not limited thereto) is formed on the spring fixing base 28. The three limiting blocks 54 laterally abut against the spring 18 and are arranged in a ring shape cooperatively with the fixing hook 22 for positioning the spring 18 to the spring fixing base 28 more precisely.

Via the aforesaid designs, after assembly of the cap body 26 connected to the spring 18 and the connection member 24 connected to the lifting mechanism 16 is completed (as shown in FIG. 3), the keyswitch 10 can provide a non-clicky linear tactile feedback via linear deformation of the spring 18 when the user presses the cap structure 14. As for the related description for the triggering design of the keyswitch 10 (e.g. utilizing an optical sensor to detect a travelling distance of the cap structure 14 or utilizing the lifting mechanism 16 to press a triggering switch on a circuit board), it is commonly seen in the prior art and omitted herein.

In such a manner, since the present invention utilizes the fixing ring to directly fix the spring to the cap structure and omits the operation of sequentially connecting the spring and the cap to the lifting mechanism, the user just needs to assemble the cap structure having the spring fixed thereon with the lifting mechanism, so as to complete the keyswitch assembly process quickly and conveniently. Thus, the present invention can efficiently solve the prior art problem that the assembly or replacement process of the cap and the elastic member is time-consuming and strenuous, so as to greatly improve assembly and disassembly convenience of the keyswitch.

It should be mentioned that the cap structure of the present invention is not limited to the three-piece detachable design mentioned in the aforesaid embodiment. For example, in another embodiment, the connection member and the spring fixing base could be integrally formed on the cap body to form one single integrated cap structure for simplifying the cap structural design of the present invention. As for the related description for other derived embodiments (e.g. the embodiment that only the spring fixing base is integrally formed on the cap body), it could be reasoned by analogy according to the aforesaid embodiment and omitted herein.

Figure 4:
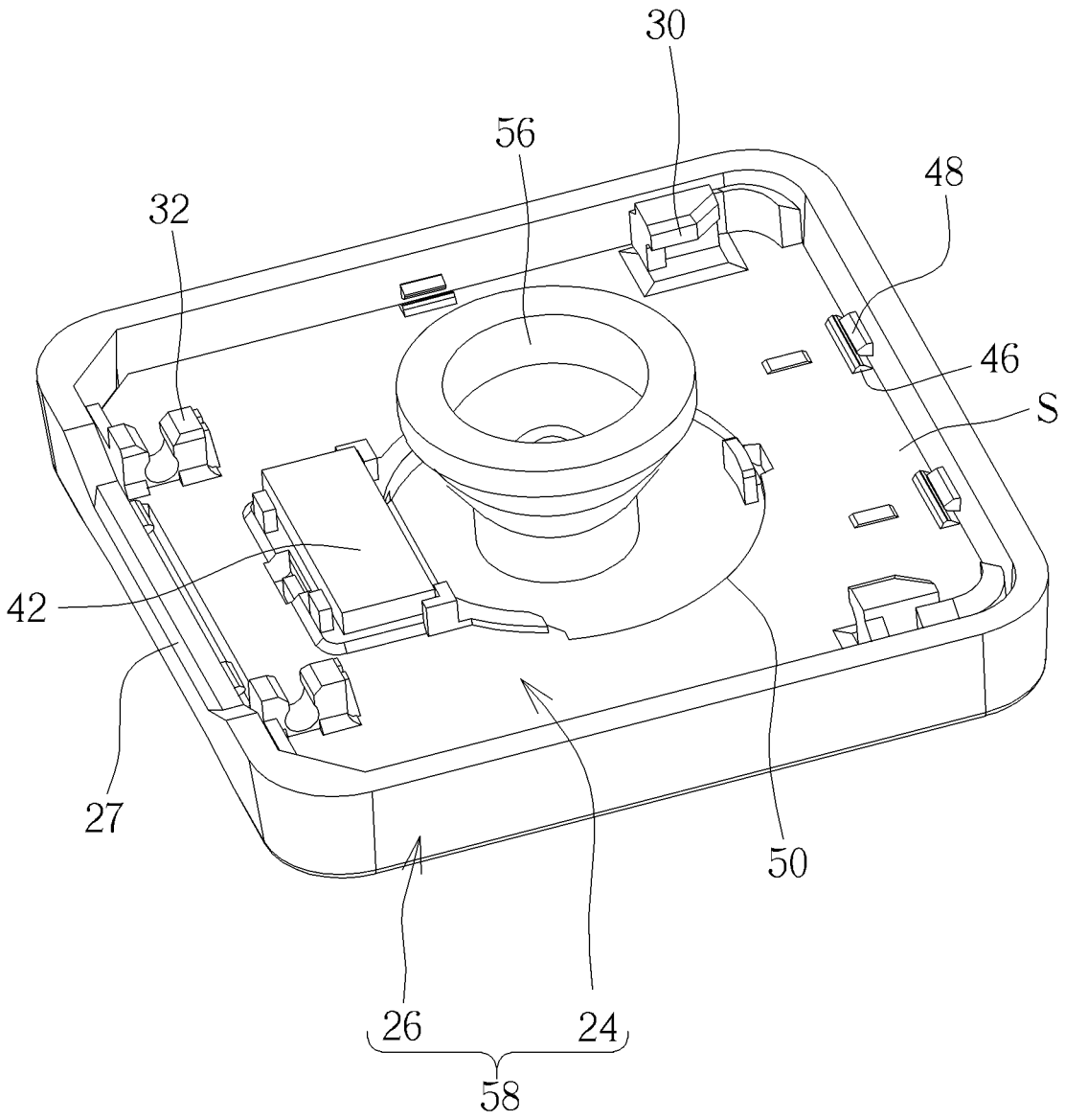
FIG. 4 is a diagram of an elastic body with tactile feedback being connected to a replaceable cap structure.
Figure 5:
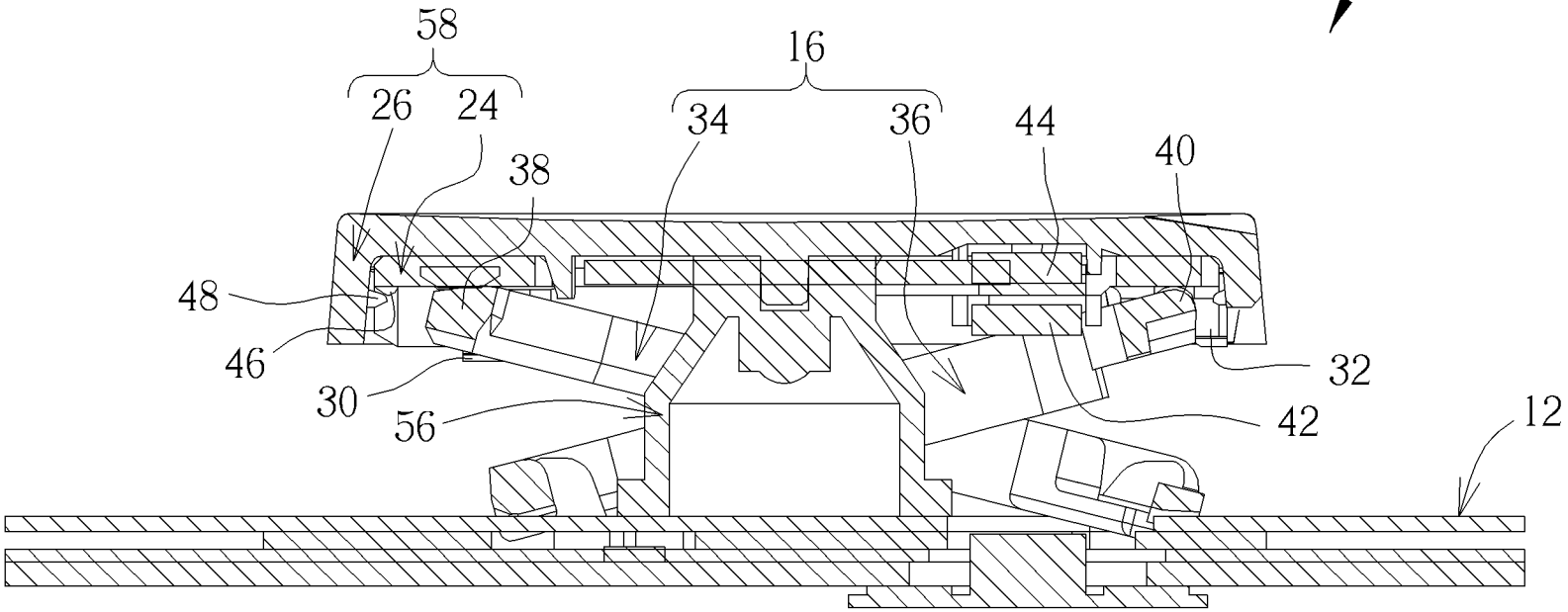
FIG. 5 is a cross-sectional diagram of the elastic body with tactile feedback and the replaceable cap structure being connected to a lifting mechanism in FIG. 4.

Furthermore, the keyswitch 10 of the present invention can provide a cap replaceable function. For example, please refer to FIG. 3, FIG. 4, and FIG. 5. FIG. 4 is a diagram of an elastic body 56 with tactile feedback being connected to a replaceable cap structure 58. FIG. 5 is a cross-sectional diagram of the elastic body 56 with tactile feedback and the replaceable cap structure 58 being connected to the lifting mechanism 16 in FIG. 4. As shown in FIG. 4 and FIG. 5, the keyswitch 10 could further include the elastic body 56 with tactile feedback and the replaceable cap structure 58. An end of the elastic body 56 with tactile feedback is connected to the replaceable cap structure 58 (e.g. by glue, but not limited thereto). Via the aforesaid design, when the user wants to switch the keyswitch 10 to provide a clicky tactile feedback, the user just needs to utilize an adjusting tool or a plier to detach the spring 18 from the lifting mechanism 16 together with the cap structure 14, and then mounts the replaceable cap structure 58 connected to the elastic body 56 with tactile feedback on the lifting mechanism 16 (as shown in FIG. 5). In such a manner, the keyswitch 10 can provide a clicky tactile feedback via the elastic body 56 with tactile feedback when the user presses the replaceable cap structure 58. To be noted, the cap detachable design that the cap body is detachably connected to the connection member or the integrated cap structural design mentioned in the aforesaid embodiments can be applied to the replaceable cap structure 58, and the related description could be reasoned by analogy according to the aforesaid description and omitted herein. As for which design is adopted, it depends on the practical application of the keyswitch 10.

Figure 6:
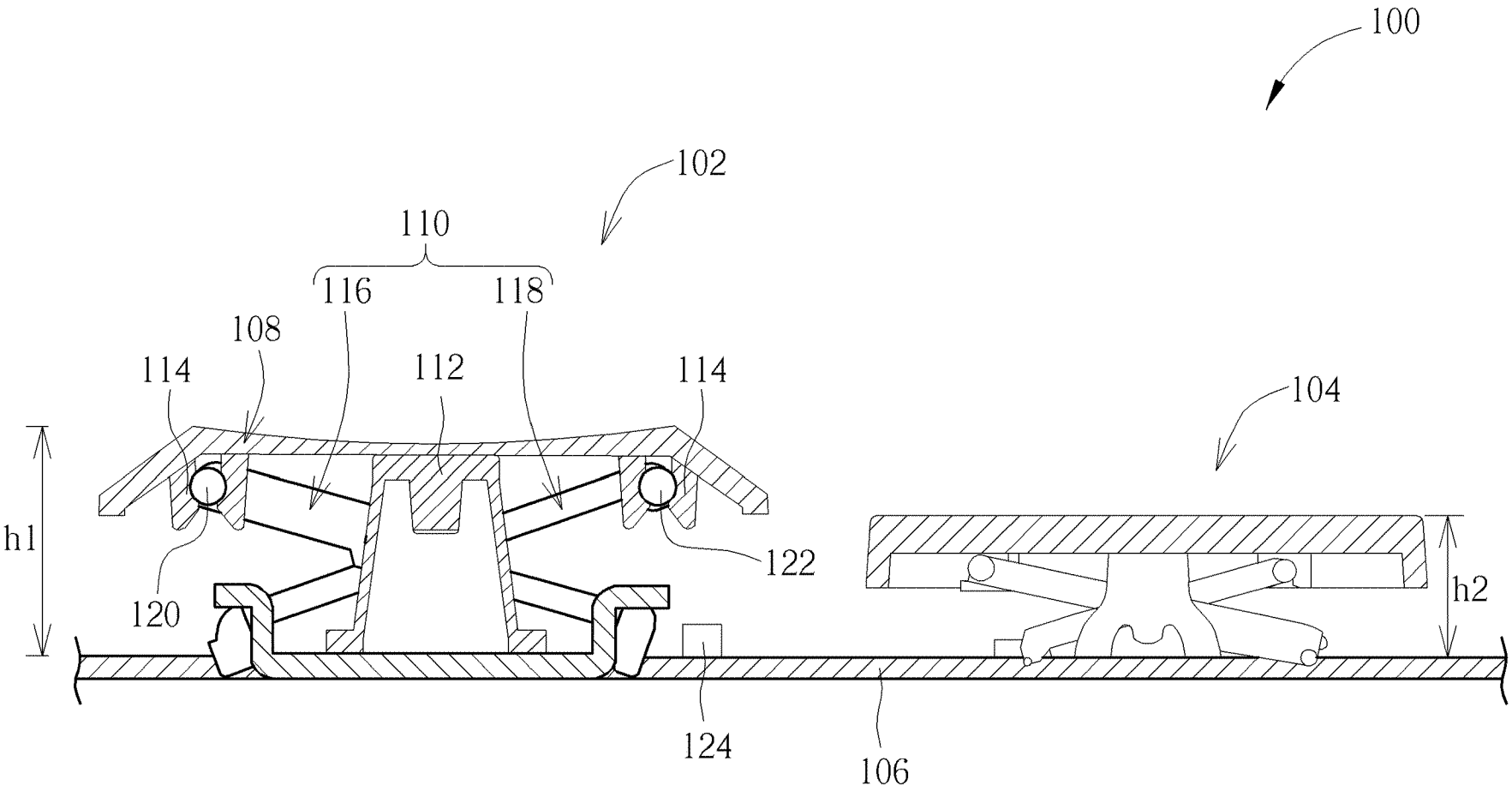
FIG. 6 is a partial cross-sectional diagram of a keyswitch according to another embodiment of the present invention.

In practical application, the lifting mechanism of the present invention is not limited to the aforesaid embodiments. For example, please refer to FIG. 6, which is a partial cross-sectional diagram of a keyswitch 100 according to another embodiment of the present invention. The keyswitch 100 includes a plurality of keyswitches 102 and a plurality of keyswitches 104 (one shown in FIG. 6 respectively) for the user to perform input functions. The cap detachable design provided by the present invention can be applied to at least one of keyswitches on a keyboard. In this embodiment, the keyswitch 102 adopts the cap detachable design of the present invention and could be preferably a keyswitch frequently used by the user (e.g. W, A, S or D key frequently used in a computer game). The keyswitch 104 does not adopt the cap detachable design of the present invention. Further, a non-pressed height h1 of the keyswitch 102 adopting the cap detachable design could be preferably higher than a non-pressed height h2 of the keyswitch 104 not adopting the cap detachable design (as shown in FIG. 6), so that the user can press the frequently-used keyswitch more quickly and precisely. More detailed description for one of the keyswitches 102 is provided as follows. The related description for the other keyswitches 102 adopting the same design could be reasoned by analogy, and the related description for the keyswitches 104 is commonly seen in the prior art and omitted herein.

As shown in FIG. 6, the keyswitch 102 includes a bottom board 106, a cap structure 108, a lifting mechanism 110, and an elastic member 112. The elastic member 112 could be an elastic body with tactile feedback (e.g. a rubber dome, but not limited thereto, meaning that the present invention could adopt other elastic member, such as a spring). The elastic member 112 could be preferably attached under the cap structure 108 by glue. The lifting mechanism 110 is detachably connected to the cap structure 108 and the bottom board 106 to make the cap structure 108 movable upward and downward relative to the bottom board 106. To be more specific, in this embodiment, two clamping slot structures 114 extend from the cap structure 108 toward the bottom board 106, and the lifting mechanism 110 includes a first support member 116 and a second support member 118. The first support member 116 and the second support member 118 pivotably intersect with each other and are slidably connected to the bottom board 106 (e.g. adopting the sliding design that the first support member 116 and the second support member 118 could have sliding shafts to be slidable in sliding slots of the bottom board 106, but not limited thereto). The first support member 116 and the second support member 118 have a first shaft end portion 120 and a second shaft end portion 122. The first shaft end portion 120 and the second shaft end portion 122 are detachably pivoted to the two clamping slot structures 114.

After assembly of the lifting mechanism 110 and the cap structure 108 connected to the elastic member 112 is completed, the keyswitch 102 can provide a clicky tactile feedback via the elastic member 112 when the user presses the cap structure 108. On the other hand, when the user wants to detach the cap structure 108, the user just needs to utilize an adjusting tool or a plier to push the cap structure 108 upward for releasing engagement between the two clamping slot structures 114 and the first and second shaft end portions 120, 122. At this time, since the elastic member 112 is connected to the cap structure 108, the elastic member 112 can be detached from the lifting mechanism 110 together with the cap structure 108, so that the user can complete the disassembly or replacement process of the cap structure 108 and the elastic member 112 quickly.

As for the triggering design of the keyswitch 102, the present invention could adopt the optical triggering design (but not limited thereto, meaning that the present invention could adopt other keyswitch triggering design, such as the structural triggering design of utilizing the lifting mechanism 110 to press a triggering switch on a circuit board). For example, as shown in FIG. 6, the keyswitch 102 could further include a distance sensor 124. The distance sensor 124 could be preferably an optical sensor (but not limited thereto) disposed on the bottom board 106. The distance sensor 124 is used to detect a velocity of the cap structure 108 relative to the bottom board 106 for determining whether the keyswitch 102 is triggered. Furthermore, the related description for other derived designs of the keyswitch 102 (e.g. the recessed structural design and the cap replaceable design) could be reasoned by analogy according to the aforesaid embodiments and omitted herein.

Figure 7:
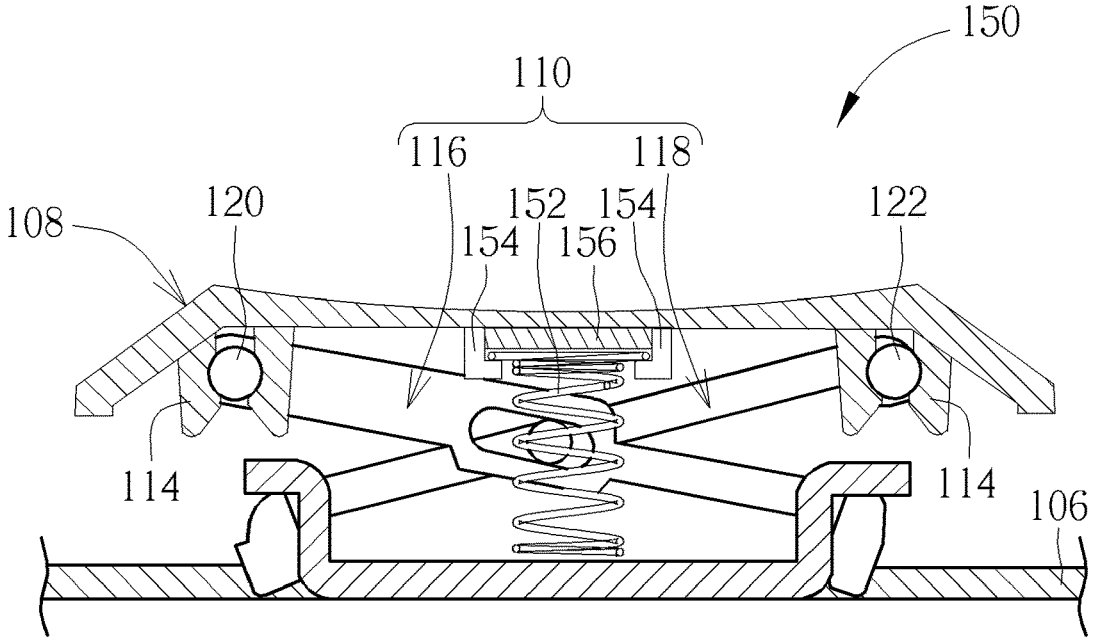
FIG. 7 is a cross-sectional diagram of a keyswitch according to another embodiment of the present invention.

In practical application, connection of the cap structure and the elastic member is not limited to the aforesaid embodiments. For example, please refer to FIG. 7, which is a cross-sectional diagram of a keyswitch 150 according to another embodiment of the present invention. Components both mentioned in this embodiment and the aforesaid embodiments represent components with similar structures or functions, and the related description is omitted herein. As shown in FIG. 7, the keyswitch 150 includes the bottom board 106, the cap structure 108, the lifting mechanism 110, and an elastic member 152. The elastic member 152 could be a spring (but not limited thereto). In this embodiment, the cap structure 108 could have the clamping structure 114 and at least one fixing hook 154 (two shown in FIG. 7, but not limited thereto). The elastic member 152 is engaged with the fixing hook 154 and is attached under the cap structure 108 by a glue layer 156. As such, when the cap structure 108 is separate from the lifting mechanism 110, the elastic member 152 can be detached from the lifting mechanism 110 together with the cap structure 108, so that the user can complete the disassembly or replacement process of the cap structure 108 and the elastic member 152 quickly. Moreover, the present invention could adopt the plunger fixing design. In brief, in another embodiment, the lifting mechanism could include a plunger and a hollow pillar. The plunger extends from the cap structure toward the bottom board, and the hollow pillar protrudes from the bottom board corresponding to the plunger. The elastic member jackets the plunger and the plunger is movably disposed through the hollow pillar, so as to abut the elastic member against the hollow pillar for driving the cap structure away from the bottom board to generate the cap returning effect. Accordingly, when the cap structure is separate from the lifting mechanism, the elastic member jacketing the plunger can be detached from the lifting mechanism together with the cap structure, so that the user can complete the disassembly or replacement process of the cap structure and the elastic member quickly. As for the related description for other derived designs of the keyswitch 150 (e.g. the recessed structural design, the triggering design, and the cap replaceable design), it could be reasoned by analogy according to the aforesaid embodiments and omitted herein.

Figure 8:
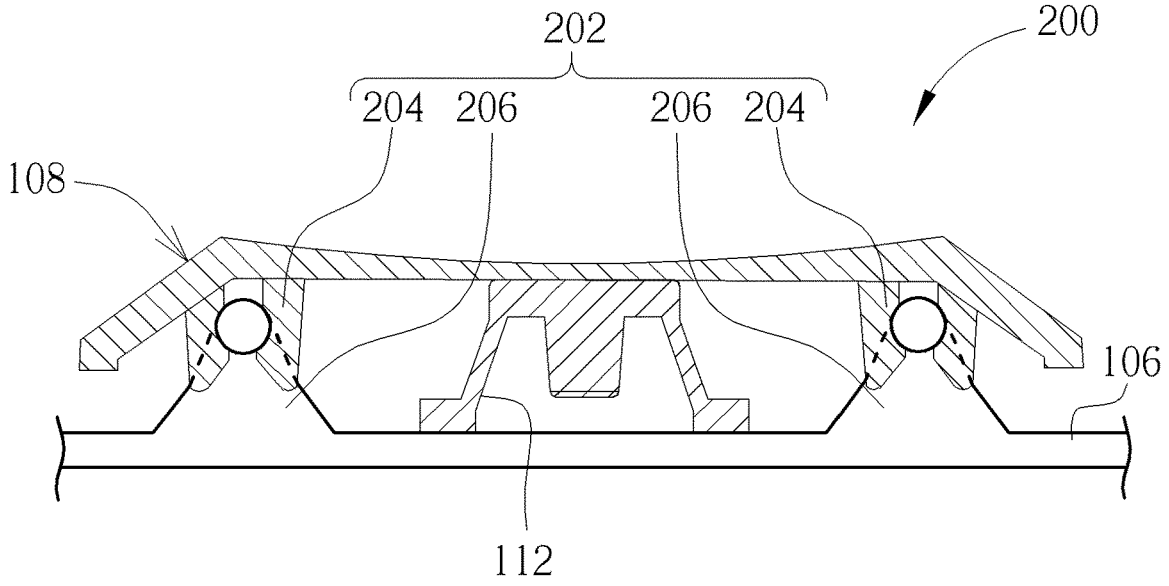
FIG. 8 is a cross-sectional diagram of a keyswitch according to another embodiment of the present invention.

In addition, the present invention can omit the lifting mechanism to be advantageous to the thinning design of the keyswitch. For example, please refer to FIG. 8, which is a cross-sectional diagram of a keyswitch 200 according to another embodiment of the present invention. Components both mentioned in this embodiment and the aforesaid embodiments represent components with similar structures or functions, and the related description is omitted herein. As shown in FIG. 8, the keyswitch 200 includes the bottom board 106, the cap structure 108, a lifting mechanism 202, and the elastic member 112. The lifting mechanism 202 includes two clamping slot structures 204 and two shaft structures 206. The two clamping slot structures 204 extend from the cap structure 108 toward the bottom board 106, and the two shaft structures 206 protrude from the bottom board 106 corresponding to the two clamping slot structures 204. The two shaft structures 206 are movably disposed in the clamping slot structures 204 for guiding movement of the cap structure 108 relative to the bottom board 106. As for the related description for other derived embodiments of the keyswitch 200 (e.g. the recessed structural design, the triggering design, and the cap replaceable design), it could be reasoned by analogy according to the aforesaid embodiments and omitted herein.

Figure 9:
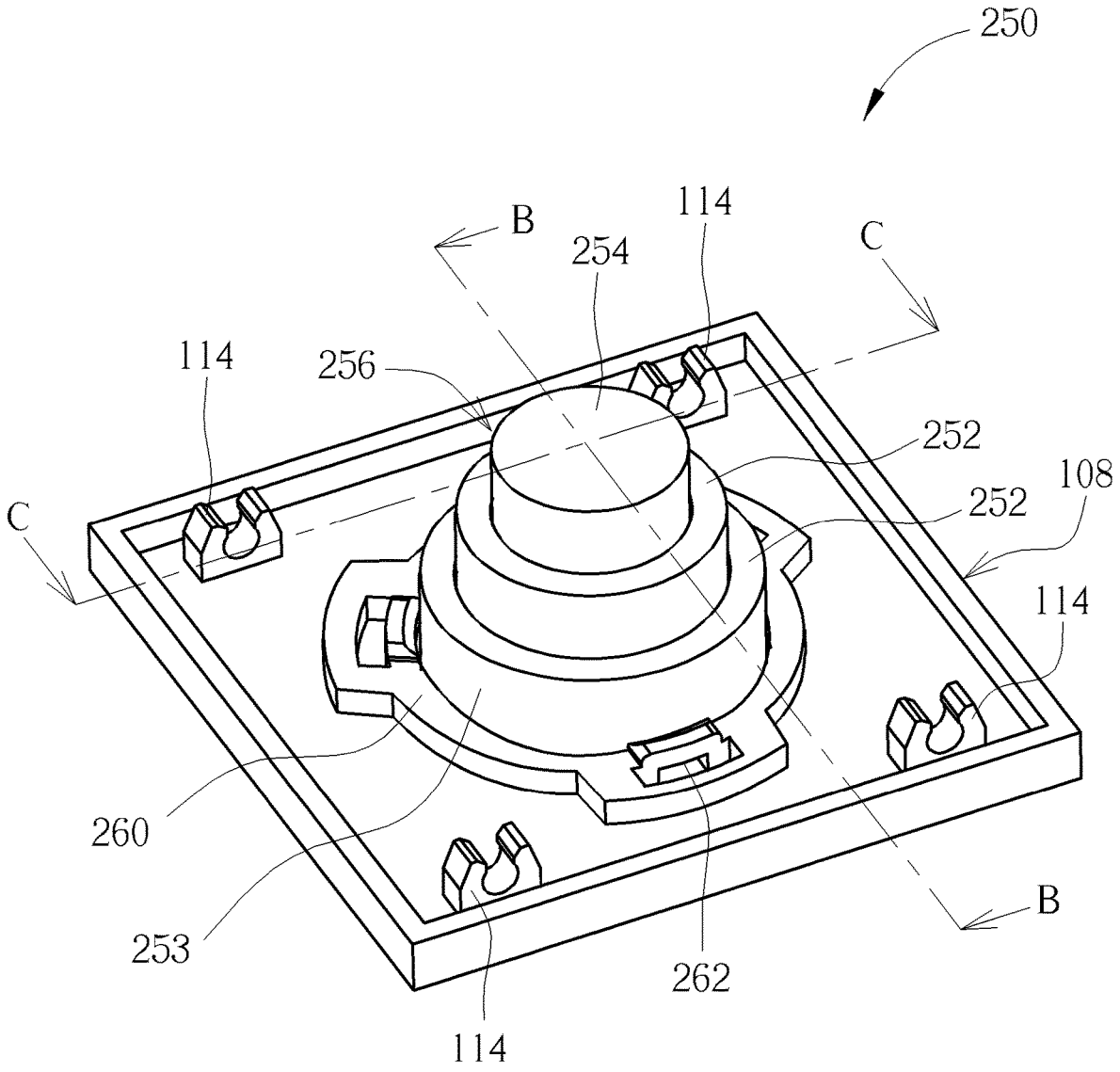
FIG. 9 is a partial assembly diagram of a keyswitch according to another embodiment of the present invention.
Figure 10:
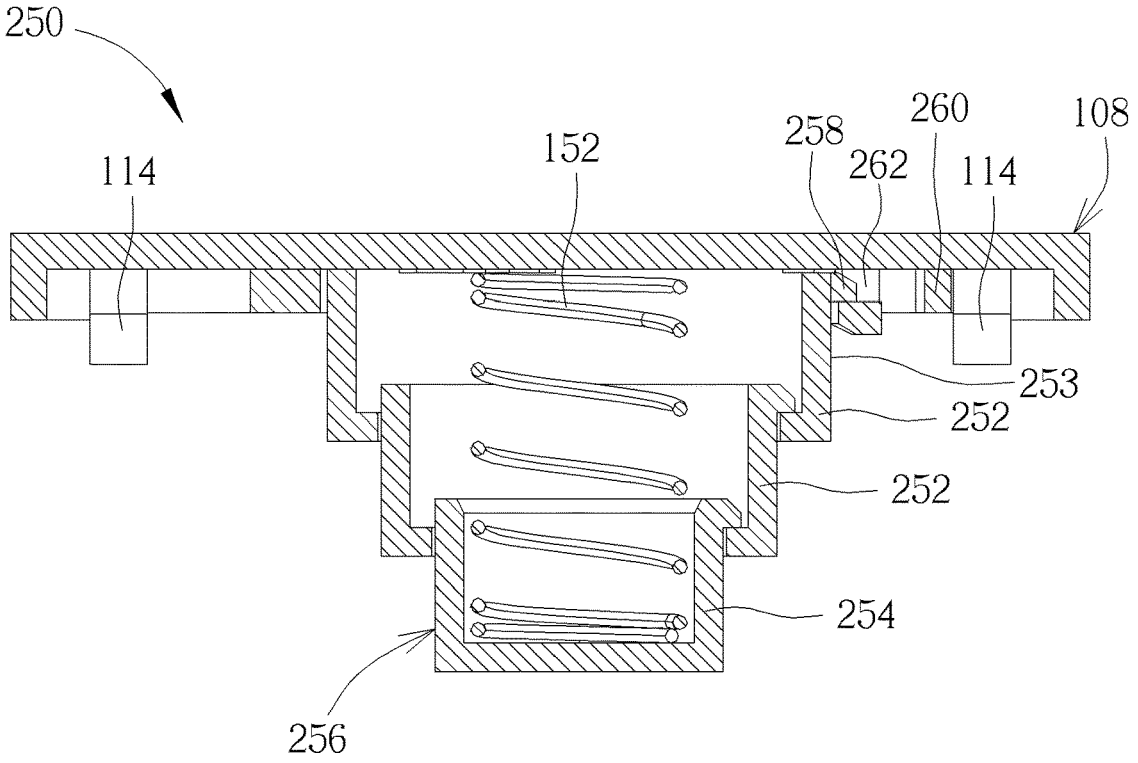
FIG. 10 is a cross-sectional diagram of the keyswitch in FIG. 9 along a cross-sectional line B-B.
Figure 11:
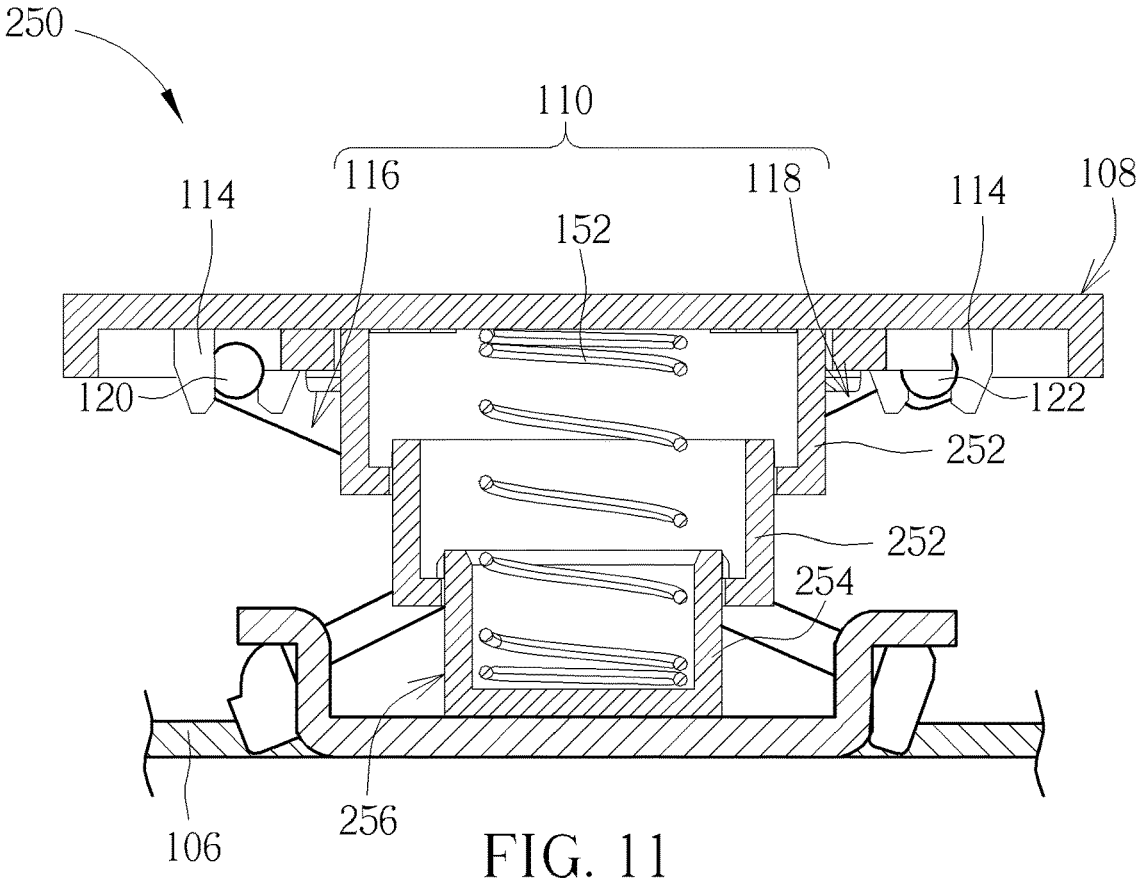
FIG. 11 is a cross-sectional diagram of the keyswitch in FIG. 9 along a cross-sectional line C-C after assembly of a cap structure and a lifting mechanism is completed.

The present invention could further adopt the protection cover design. For example, please refer to FIG. 9, FIG. 10, and FIG. 11. FIG. 9 is a partial assembly diagram of a keyswitch 250 according to another embodiment of the present invention. FIG. 10 is a cross-sectional diagram of the keyswitch 250 in FIG. 9 along a cross-sectional line B-B. FIG. 11 is a cross-sectional diagram of the keyswitch 250 in FIG. 9 along a cross-sectional line C-C after assembly of the cap structure 108 and the lifting mechanism 110 is completed. Components both mentioned in this embodiment and the aforesaid embodiments represent components with similar structures or functions, and the related description is omitted herein. As shown in FIG. 9, FIG. 10, and FIG. 11, the keyswitch 250 includes the bottom board 106, the cap structure 108, the lifting mechanism 110, the elastic member 152, a plurality of connection sleeves 252 (two shown in FIG. 9, but not limited thereto), and a cover sleeve 254. The plurality of connection sleeves 252 is formed sequentially with gradually decreasing diameters and telescopically connected to each other in a nested configuration. The connection sleeve 252 having a maximum diameter is connected to the cap structure 108 to make the plurality of connection sleeves 252 surround the elastic member 152. The cover sleeve 254 jackets the elastic member 152 and is telescopically disposed through the connection sleeve 252 having a minimum diameter, so that the cover sleeve 254 and the plurality of connection sleeves 252 can form a telescopic sleeve structure 256 cooperatively. As such, the telescopic sleeve structure 256 can abut against the bottom board 106 and contain the elastic member 154 (as shown in FIG. 11) to protect the elastic member 152 when the elastic member 152 deforms with upward and downward movement of the cap structure 108, so as to increase the service life of the elastic member 152.

Moreover, the present invention could adopt the structural engagement design to connect the connection sleeve 252 and the cap structure 108 (but not limited thereto, meaning that the present invention could adopt the glue fixing design in another embodiment). In this embodiment, as shown in FIG. 9 and FIG. 10, at least one rib 258 (one shown in FIG. 10, but not limited thereto) protrudes outwardly from a periphery 253 of the connection sleeve 252 having the maximum diameter, and the keyswitch 250 further includes a fixing ring 260. The fixing ring 260 jackets the connection sleeve 252 having the maximum diameter and is connected to the cap structure 108 (e.g. by glue). The fixing ring 260 has a fixing slot 262 formed thereon corresponding to the rib 258. In such a manner, the fixing slot 262 can be engaged with the rib 258 to fix the connection sleeve 252 having the maximum diameter to the cap structure 108. As for the related description for other derived embodiments of the keyswitch 250 (e.g. the recessed structural design, the triggering design, and the cap replaceable design), it could be reasoned by analogy according to the aforesaid embodiments and omitted herein.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch comprising:

a bottom board;

a cap structure comprising a connection member, a cap body, and a spring fixing base, the connection member being detachably disposed under the cap body;

a lifting mechanism detachably connected to the connection member and the bottom board to make the cap structure movable upward and downward relative to the bottom board;

an elastic member connected to the cap structure to be detached from the lifting mechanism together with the cap structure when the cap structure is separate from the lifting mechanism, the elastic member being a spring, a hole being formed on the connection member corresponding to the spring, at least one fixing hook being formed on the spring fixing base and connected to the cap body corresponding to the hole, one end of the elastic member being engaged with the at least one fixing hook, at least one limiting block being formed on the spring fixing base, the at least one limiting block laterally abutting against the spring, the at least one limiting block being arranged in a ring shape cooperatively with the at least one fixing hook for positioning the spring to the spring fixing base, and another end of the elastic member abutting against the bottom board for driving the cap structure away from the bottom board; and a connection ring detachably engaged with the at least one fixing hook to clamp the one end of the spring cooperatively with the spring fixing base of the cap structure.

2. The keyswitch of claim 1, wherein the spring fixing base is attached under the cap body by glue.

3. The keyswitch of claim 1, wherein the connection member has a first magnetic member, the cap body has a second magnetic member corresponding to the first magnetic member, and the first magnetic member magnetically attracts the second magnetic member to make the connection member detachably connected to the cap body.

4. The keyswitch of claim 3, wherein a recessed structure is formed on a side of the cap body corresponding to the second magnetic member.

5. The keyswitch of claim 1, wherein at least one first positioning structure is formed on at least one edge of the connection member, a second positioning structure is formed on the cap body corresponding to the at least one first positioning structure, and the at least one first positioning structure is engaged with the second positioning structure to make the connection member detachably connected to the cap body.

6. A keyboard comprising:

a bottom board; and a plurality of keyswitches disposed on the bottom board, at least one of the plurality of keyswitches comprising:

a cap structure comprising a connection member, a cap body, and a spring fixing base, the connection member being detachably disposed under the cap body, at least one limiting block being formed on the spring fixing base;

a lifting mechanism detachably connected to the connection member and the bottom board to make the cap structure movable upward and downward relative to the bottom board;

an elastic member connected to the cap structure to be detached from the lifting mechanism together with the cap structure when the cap structure is separate from the lifting mechanism, the elastic member being a spring, a hole being formed on the connection member corresponding to the spring, at least one fixing hook being formed on the spring fixing base and connected to the cap body corresponding to the hole, one end of the elastic member being engaged with the at least one fixing hook, at least one limiting block being formed on the spring fixing base, the at least one limiting block laterally abutting against the spring, the at least one limiting block being arranged in a ring shape cooperatively with the at least one fixing hook for positioning the spring to the spring fixing base, and another end of the elastic member abutting against the bottom board for driving the cap structure away from the bottom board; and a connection ring detachably engaged with the at least one fixing hook to clamp the one end of the spring cooperatively with the spring fixing base of the cap structure.

7. A keyswitch comprising:

a bottom board;

a cap structure comprising a connection member, a cap body, and a spring fixing base, the connection member being detachably disposed under the cap body, the connection member having a first magnetic member, the cap body having a second magnetic member corresponding to the first magnetic member, and the first magnetic member magnetically attracting the second magnetic member to make the connection member detachably connected to the cap body;

a lifting mechanism detachably connected to the connection member and the bottom board to make the cap structure movable upward and downward relative to the bottom board;

an elastic member connected to the cap structure to be detached from the lifting mechanism together with the cap structure when the cap structure is separate from the lifting mechanism, the elastic member being a spring, a hole being formed on the connection member corresponding to the spring, at least one fixing hook being formed on the spring fixing base and connected to the cap body corresponding to the hole, one end of the elastic member being engaged with the at least one fixing hook, and another end of the elastic member abutting against the bottom board for driving the cap structure away from the bottom board; and a connection ring detachably engaged with the at least one fixing hook to clamp the one end of the spring cooperatively with the spring fixing base.

8. A keyswitch comprising:

a bottom board;

a cap structure comprising a connection member, a cap body, and a spring fixing base, the connection member being detachably disposed under the cap body, at least one first positioning structure being formed on at least one edge of the connection member, a second positioning structure being formed on the cap body corresponding to the at least one first positioning structure, and the at least one first positioning structure being engaged with the second positioning structure to make the connection member detachably connected to the cap body;

a lifting mechanism detachably connected to the connection member and the bottom board to make the cap structure movable upward and downward relative to the bottom board;

an elastic member connected to the cap structure to be detached from the lifting mechanism together with the cap structure when the cap structure is separate from the lifting mechanism, the elastic member being a spring, a hole being formed on the connection member corresponding to the spring, at least one fixing hook being formed on the spring fixing base and connected to the cap body corresponding to the hole, one end of the elastic member being engaged with the at least one fixing hook, and another end of the elastic member abutting against the bottom board for driving the cap structure away from the bottom board; and a connection ring detachably engaged with the at least one fixing hook to clamp the one end of the spring cooperatively with the spring fixing base.

* * * * *